US010941970B2

(12) United States Patent
Encinas

(10) Patent No.: US 10,941,970 B2
(45) Date of Patent: Mar. 9, 2021

(54) PORTABLE COOLER APPARATUS

(71) Applicant: Pedro Encinas, Chandler, AZ (US)

(72) Inventor: Pedro Encinas, Chandler, AZ (US)

( * ) Notice: Subject to any disclaimer, the term of this patent is extended or adjusted under 35 U.S.C. 154(b) by 0 days.

(21) Appl. No.: 14/056,533

(22) Filed: Oct. 17, 2013

(65) Prior Publication Data

US 2015/0107293 A1 Apr. 23, 2015

(51) Int. Cl.
*F25D 3/08* (2006.01)

(52) U.S. Cl.
CPC ..... *F25D 3/08* (2013.01); *F25D 2303/081* (2013.01); *F25D 2331/812* (2013.01)

(58) Field of Classification Search
CPC ... B65D 83/005; F25D 3/08; F25D 2303/081; F25D 2331/812
USPC ..... 220/522, 528, 521; 62/457.7; 312/35
See application file for complete search history.

(56) References Cited

U.S. PATENT DOCUMENTS 1,625,803 A 4/1927 Hass et al.
1,945,805 A * 2/1934 Fitz Gerald ..... 312/73
2,101,281 A 12/1937 Porter
2,570,300 A 10/1951 Acton
2,624,451 A 1/1953 Ewing
2,964,157 A * 12/1960 Knight ..... B41J 31/16 118/251
3,019,494 A * 2/1962 Horie ..... A61L 2/00 206/208
3,384,259 A 5/1968 Hoffstadt
3,482,418 A 12/1969 Moore
4,424,687 A * 1/1984 Morgan ..... F25D 3/08 62/457.1
4,796,785 A 1/1989 Merritt
4,978,023 A 12/1990 Behlmann et al.
5,329,787 A 7/1994 Friday
5,423,426 A 6/1995 Harper
D365,969 S 1/1996 Sellman
5,671,611 A 9/1997 Quigley
5,868,266 A * 2/1999 Nobakht ..... A47G 19/30 206/804
6,315,149 B1 11/2001 Conrado et al.
D473,751 S * 4/2003 Kaposi ..... D7/409
6,629,430 B2 10/2003 Mills et al.
6,763,678 B2 7/2004 Harper
7,100,393 B2 * 9/2006 D'Angelo ..... F25D 31/007 62/372
7,269,969 B2 9/2007 Strickland et al.
7,690,523 B2 * 4/2010 Harris ..... 220/23.89
2006/0021376 A1 2/2006 Scroggs
2006/0163263 A1 7/2006 Helline
2006/0254431 A1 * 11/2006 Mariano ..... A47J 36/20 99/415
2007/0101754 A1 5/2007 Strickland et al.

FOREIGN PATENT DOCUMENTS

FR 2750404 A1 * 1/1998

* cited by examiner

*Primary Examiner* — Anthony D Stashick
*Assistant Examiner* — Blaine G Neway
(74) *Attorney, Agent, or Firm* — Venjuris, P.C.

(57) ABSTRACT

A portable cooler apparatus that is used to cool liquids and perishable food items simultaneously while not contaminating the liquid is disclosed. The portable cooler apparatus includes a container, a lid, a telescoping member, and a tray. These items are coupled in such a way that the desired result of refrigeration and non-contaminated drinking liquid is simultaneously provided.

8 Claims, 4 Drawing Sheets

PORTABLE COOLER APPARATUS

FIELD OF THE INVENTION

The present invention relates generally to a liquid dispensing portable cooler apparatus, and more particularly, to a liquid dispensing portable cooler apparatus that includes a telescoping member with a tray to hold food and beverage containers within the cooler. The tray of the portable cooler apparatus allows food and beverage containers to be separated from drinking liquid within the container while at the same time pressing ice into the drinking liquid in order to immediately cool the liquid.

BACKGROUND OF THE INVENTION

Liquid dispensing portable coolers are well known. In general, these liquid dispensing coolers are used to keep liquids cold while away from refrigeration and allow users to dispense cold beverages from the cooler to consume. It is desirable to keep contaminants and debris out of the cold liquid in the dispensing cooler because the liquid is usually used as a beverage for people. However, it is sometimes desirable to use the liquid dispensing cooler to cool perishable food and keep bottled/canned beverages cold while at the same time having a clean beverage to dispense for consumption.

The ice and/or cooled liquid in the liquid dispensing cooler can provide the cooling needed to keep food items, such as sandwiches or fruit, and bottled or canned beverages cool. In this type of situation it is desirable to keep the food items and bottled/canned beverage items separate from the liquid in the liquid dispensing cooler. If the food items and/or bottled/canned beverages are combined with the liquid in the cooler, the liquid can become contaminated, and the food items will get wet which may be undesirable.

The prior art shows some of the solutions that have been created to aid in solving the problem of separating the food and bottled/canned beverage items separate from the liquid in the liquid dispensing cooler. However, none of these prior art designs solve the problem of using a standard sized portable liquid dispensing cooler that separates the solid items from the liquid.

SUMMARY OF THE INVENTION

As such, the present invention is directed to a liquid dispensing portable cooler that provides a separation between the cooled liquid to be dispensed and food and/or bottled/canned beverage items.

The current invention includes a container and a removable lid with an inside and an outside and a tray. The lid further comprises a telescoping member that is coupled to the inside of the lid. The tray further comprises an inner surface and an outer surface. The inner surface of the tray is coupled to the telescoping member such that the tray is vertically movable within the container. The lid couples to the container such that the tray and telescoping member fit within the container.

It is an object of the present invention to provide a liquid dispensing portable cooler that also accommodates food items and bottled/canned beverages.

It is a further object of the present invention to provide a liquid dispensing portable cooler that can accommodate food items and bottled/canned beverages without damaging the items or immersing them in liquid.

It is a further object of the present invention to provide a liquid dispensing portable cooler that provides quick cooling of the internal liquid by pressing the ice into the internal liquid.

It is a further object of the present invention to provide a light weight liquid dispensing portable cooler that is easily transported and stored.

It is a further object of the present invention to provide a liquid dispensing portable cooler that is multi-functional and allows sanitary storage of a liquid beverage and food and bottled/canned beverage items.

The novel features that are considered characteristic of the invention are set forth with particularity in the appended claims. The invention itself, however, both as to its structure and its operation together with the additional object and advantages thereof will best be understood from the following description of the preferred embodiment of the portable liquid dispensing cooler. Unless specifically noted, it is intended that the words and phrases in the specification and claims be given the ordinary and accustomed meaning to those of ordinary skill in the applicable art or arts. If any other meaning is intended, the specification will specifically state that a special meaning is being applied to a word or phrase. Likewise, the use of the words "function" or "means" in the Description of Preferred Embodiments is not intended to indicate a desire to invoke the special provision of 35 U.S.C. §112, paragraph 6 to define the invention. To the contrary, if the provisions of 35 U.S.C. §112, paragraph 6 are sought to be invoked to define the invention(s), the claims will specifically state the phrases "means for" or "step for" and a function, without also reciting in such phrases any structure, material, or act in support of the function.

Moreover, even if the provisions of 35 U.S.C. §112, paragraph 6 are invoked to define the inventions, it is intended that the inventions not be limited only to the specific structure, material or acts that are described in the preferred embodiments, but in addition, include any and all structures, materials or acts that perform the claimed function, along with any and all known or later developed equivalent structures, materials, or acts for performing the claimed function.

DESCRIPTION OF PREFERRED EMBODIMENTS

Figure 2:
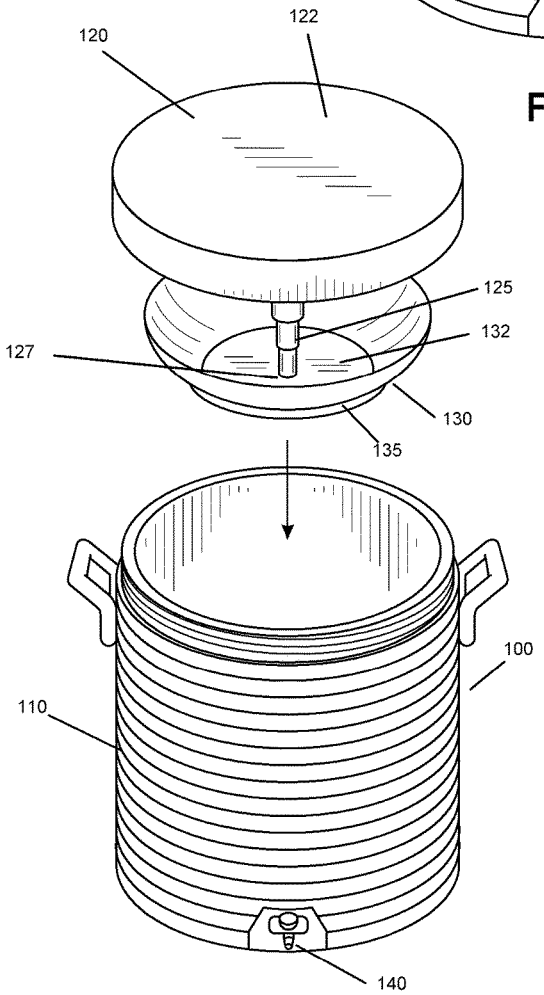
FIG. 2 is a front view of the invention with the lid completely removed.

The present invention relates to a portable cooling device 100 that allows simultaneous cooling of food items and drinking liquid. As can be seen in FIG. 2, the preferred embodiment of the portable cooling device 100 includes a container 110, a lid 120, a telescoping member 125 with a first end 126 and a second end 127, and a tray 130 with an inner surface 132 and an outer surface 135. The first end 126 of the telescoping member 125 is coupled to the inside 124 of the lid 120, and the second end 127 of the telescoping member 125 is coupled to the inner surface 132 of the tray 130. The telescoping member 125 is vertically movable within the container 110 depending on the depth of the drinking liquid inside the container 110. The lid 120 is removably coupled to the container 110 such that the lid 120, telescoping member 125, and tray 130 can be easily removed from and attached to the container 110 as necessary. The removal and attachment of the lid 120 is depicted in FIGS. 2 and 3.

Figure 4:
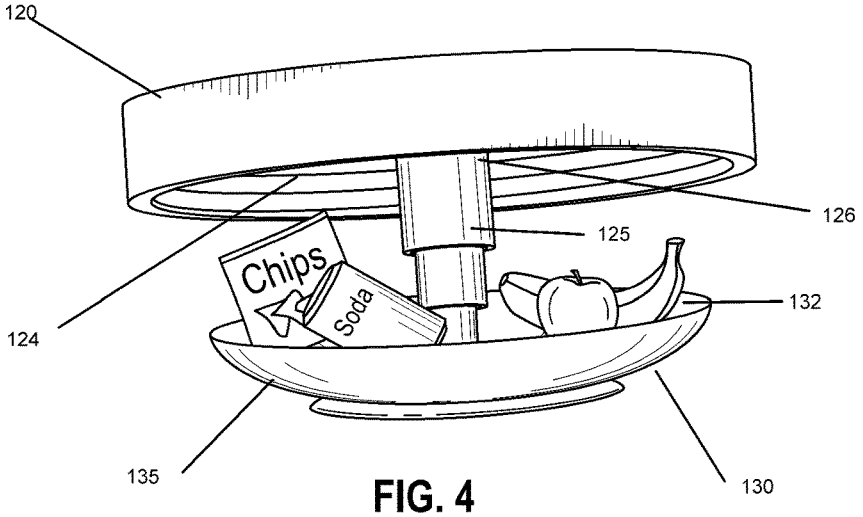
FIG. 4 is a view of the lid of the invention showing a tray with food items.

As seen in FIG. 4, the tray 130 is filled with food items that the user wishes to be cooled, and the container 110 is filled with drinking liquid, preferably water, and ice that the user wishes to be cooled or remain cool for drinking. The tray 130 filled with food items is placed into the container 110 via the telescoping member 125 attached to the lid 120 and allows the food items to be cooled using the drinking liquid and ice in the container 110. The structure of the tray 130 provides a barrier between the liquid and ice mixture while still allowing the cooling of the food. When a user wishes to retrieve a cold food item, he or she removes the lid 120 and tray 130 via the telescoping member 125 from the container 110. This prevents the user from placing his or her hand into the drinking liquid and ice mixture and possibly contaminating the drinking water with germs or other contaminants on the hand.

Figure 1:
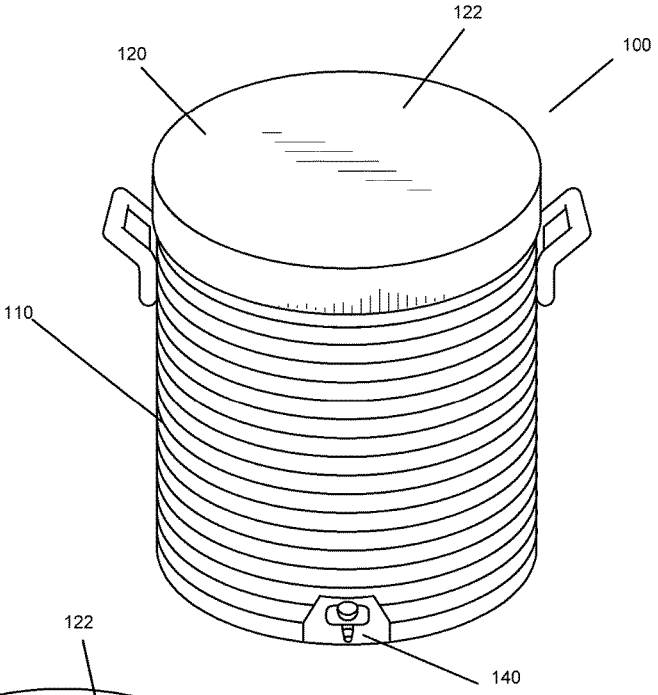
FIG. 1 is a perspective view of the invention in a closed position.
Figure 3:
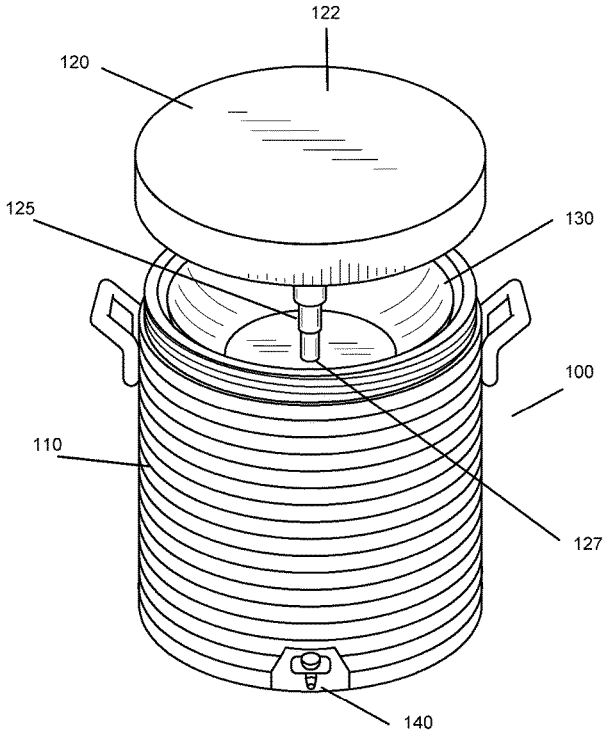
FIG. 3 is a front view of the invention with the lid in a partially closed position.

As shown in FIGS. 1, 2, and 3, the container 110 also includes a dispenser 140 where the cooled water and ice mixture can be dispensed into a cup or other receptacle. As the liquid level in the container 110 goes down with the amount of liquid dispensed, the telescoping member 125 allows the tray 130 to also descend in the container 110 and remain near the cold water and ice mixture to keep the food items at the coldest possible temperature. This configuration also allows for the ice to be pressed down into the liquid and quickly cooled.

Figure 5:
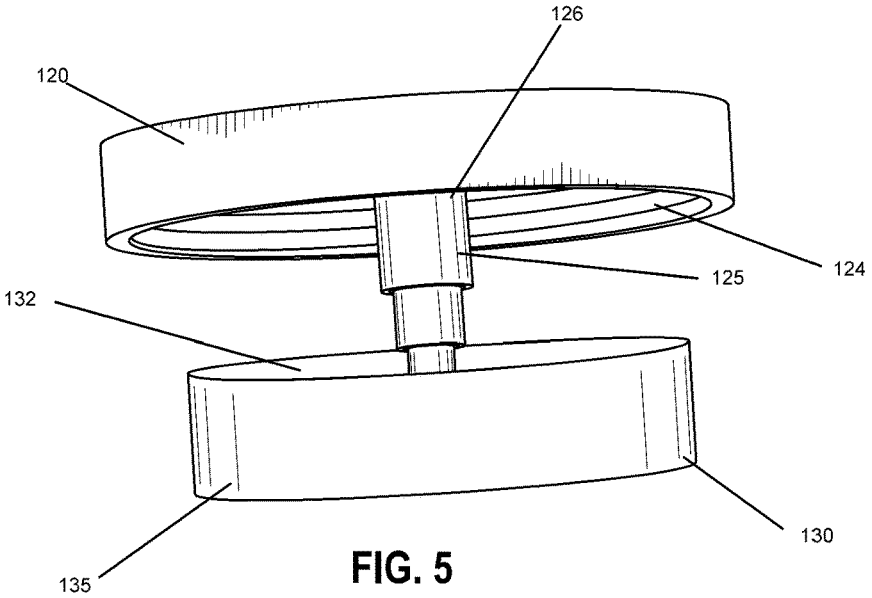
FIG. 5 is a view of the lid of the invention showing an alternative embodiment of the tray.
Figure 6:
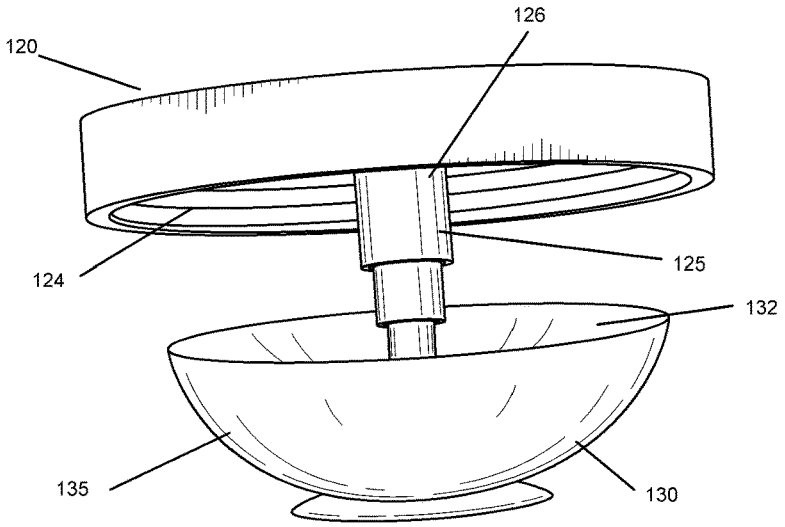
FIG. 6 is a view of the lid of the invention showing a further alternative embodiment of the tray.

The shape of the tray 130 is such that it can fit into the container 110. FIGS. 4-9 show several different embodiments of the tray that can be used in the invention. FIG. 4 shows a bowl shaped tray 130 with shallow, curved edges. FIG. 5 shows a bowl shaped tray 130 with straight edges. FIG. 6 shows a bowl shaped tray 130 with deep, curved edges.

Figure 7:
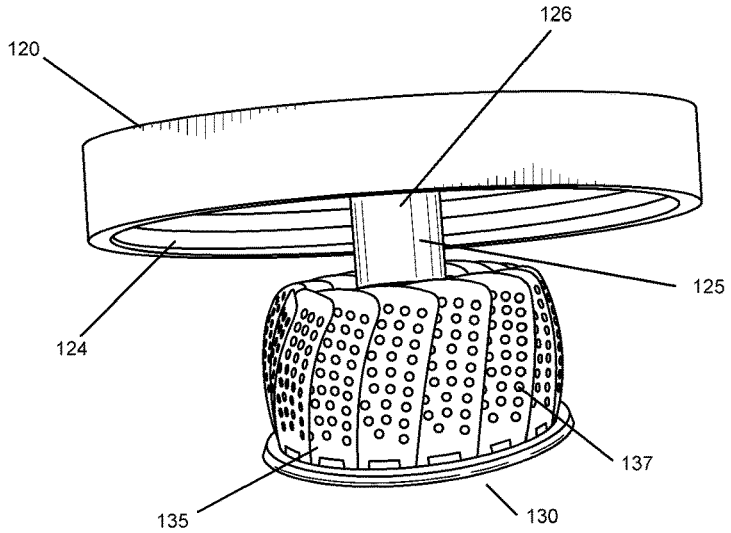
FIG. 7 is a view of the lid of the invention showing a further alternative embodiment of the tray in a closed position with holes.
Figure 8:
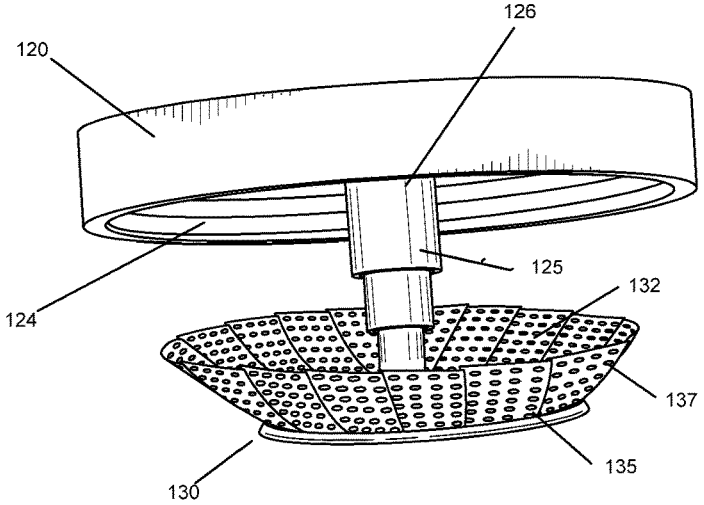
FIG. 8 is a view of the lid of the invention showing the alternative embodiment of the tray in FIG. 7 in a partially open position with holes.
Figure 9:
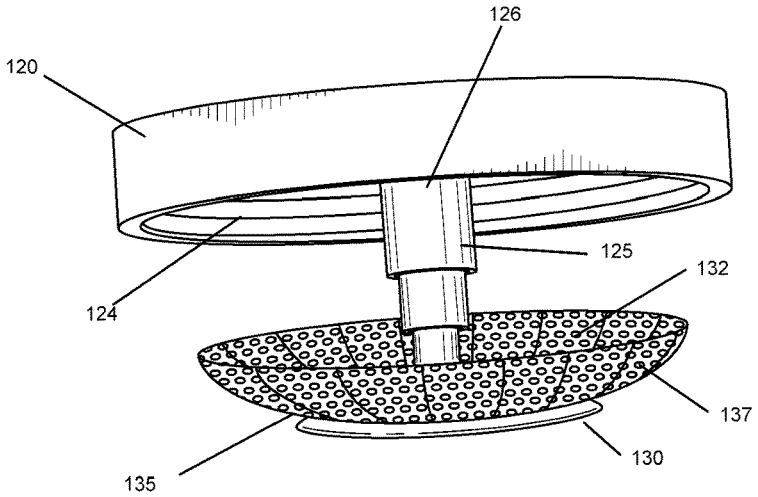
FIG. 9 is a view of the lid of the invention showing the alternative embodiment of the tray in FIG. 7 in an open position with holes.

A further alternate embodiment shown in FIGS. 7-9 includes a folding tray 130 with a plurality of holes 137. The holes 137 allow liquid in the container 110 that may have gotten in to the try 130 to easily drain back in to the container 110 once the tray 130 has been lifted above the liquid level in the container 110. This prevents liquid from being dripped or spilled out of the container 110 when the user is ready to use a food item. The folding nature of the tray 130 also allows the tray 130 to become more compact when it is storing less or no food items.

Figure 10:
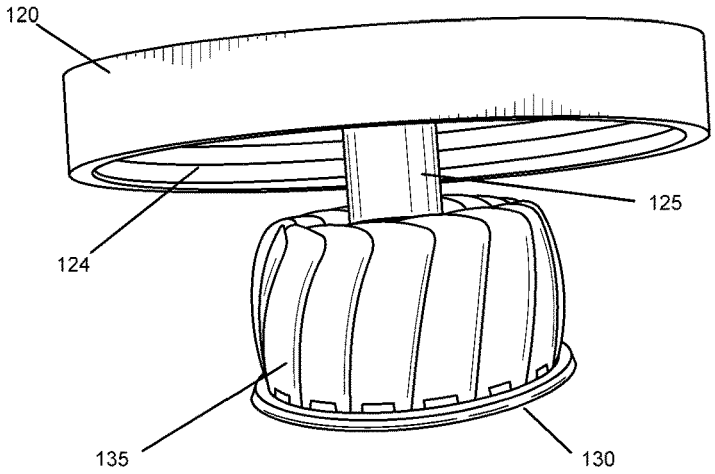
FIG. 10 is a view of the lid of the invention showing a further alternative embodiment of the tray in a closed position.
Figure 11:
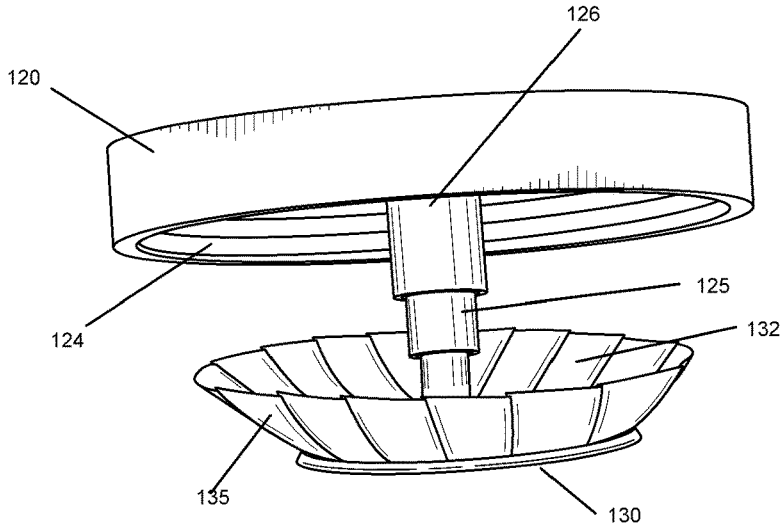
FIG. 11 is a view of the lid of the invention showing the alternative embodiment of the tray in FIG. 10 in a partially open position.
Figure 12:
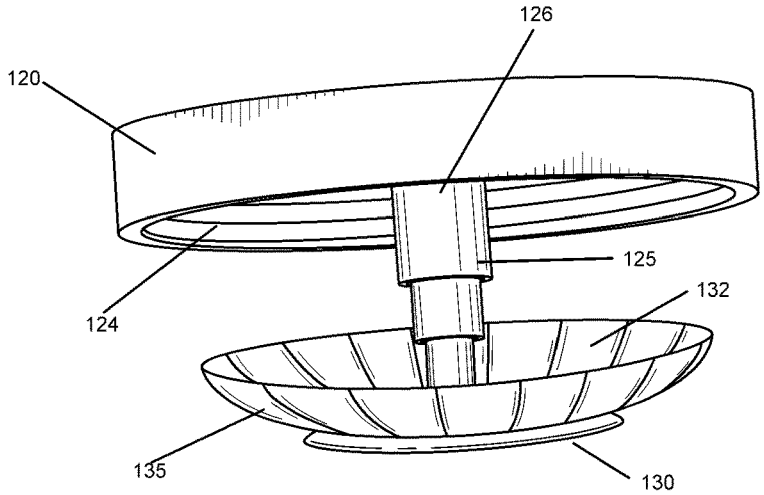
FIG. 12 is a view of the lid of the invention showing the alternative embodiment of the tray in FIG. 10 in an open position.

A similar alternate embodiment is depicted in FIGS. 10-12. In particular, the tray 130 is of a folding nature, but does not have holes. A user may prefer this type of tray 130 in a situation where contact with liquid could damage the food items. The folding nature of this tray 130 also allows for the tray 130 to become more compact when it is storing less or no food items.

The user may wish to use any one of these shown trays 130 in different situations. Therefore, the connection of the second end 127 of the telescoping member 125 to the inner side of the tray 130 is a screw type connection. Thus, the tray 130 can be interchanged by simply unscrewing one tray 130 configuration and screwing in the desired tray 130 configuration.

It is preferred that the telescoping member 125 and tray 130 are made of non-corrosive metal, plastic, or other non-corrosive materials. Because the telescoping member 125 and tray 130 will be used in a liquid environment, it is important that they are not susceptible to corrosion. It would be undesirable for the telescoping member 125 and tray 130 to corrode and possibly contaminate the drinking liquid in the container 110.

The preferred embodiment of the invention is described in the Description of Preferred Embodiments. While these descriptions directly describe the one embodiment, it is understood that those skilled in the art may conceive modifications and/or variations to the specific embodiments shown and described herein. Any such modifications or variations that fall within the purview of this description are intended to be included therein as well. Unless specifically noted, it is the intention of the inventor that the words and phrases in the specification and claims be given the ordinary and accustomed meanings to those of ordinary skill in the applicable art(s). The foregoing description of a preferred embodiment and best mode of the invention known to the applicant at the time of filing the application has been presented and is intended for the purposes of illustration and description. It is not intended to be exhaustive or to limit the invention to the precise form disclosed, and many modifications and variations are possible in the light of the above teachings. The embodiment was chosen and described in order to best explain the principles of the invention and its practical application and to enable others skilled in the art to best utilize the invention in various embodiments and with various modifications as are suited to the particular use contemplated.

What is claimed is:

1. A portable cooler apparatus comprising:

a. a container;

b. a lid with an inside and an outside;

c. a bidirectional telescoping member with a first end and a second end;

d. a tray with an inner surface and an outer surface;

e. wherein the container holds liquid wherein the depth of the liquid is vertically movable within the container;

f. wherein the first end of the bidirectional telescoping member is coupled to the inner surface of the tray such that the tray adjusts in a bi-directionally vertical manner within the container based on the level of the liquid in the container;

g. wherein the second end of the bidirectional telescoping member is coupled to the inside of the lid; and h. wherein the lid is removably coupled to the container such that the tray and lid fit within the container.

2. The portable cooler apparatus of claim 1 wherein the tray is a folding tray.

3. The portable cooler apparatus of claim 1 wherein the tray further comprises a plurality of holes such that the liquid can drain through the holes.

4. The portable cooler apparatus of claim 1 wherein the tray is made of plastic.

5. The portable cooler apparatus of claim 1 wherein the tray is made of metal.

6. The portable cooler apparatus of claim 1 wherein the container further comprises an opening wherein liquid can be dispensed from the container.

7. The portable cooler apparatus of claim 1 wherein the container is made of plastic.

8. The portable cooler apparatus of claim 1 wherein the container further comprises a dispenser on an outside surface of the container.

* * * * *